US008006609B2

(12) United States Patent
Kallio et al.

(10) Patent No.: US 8,006,609 B2
(45) Date of Patent: Aug. 30, 2011

(54) SLIDE CATCH-EJECTOR ASSEMBLY FOR FIREARM

(75) Inventors: Robert A. Kallio, Conesus, NY (US); James McGarry, Prescott Valley, AZ (US)

(73) Assignee: Sturm, Ruger & Company, Inc., Southport, CT (US)

( * ) Notice: Subject to any disclaimer, the term of this patent is extended or adjusted under 35 U.S.C. 154(b) by 190 days.

(21) Appl. No.: 12/205,202

(22) Filed: Sep. 5, 2008

(65) Prior Publication Data

US 2010/0281735 A1 Nov. 11, 2010

Related U.S. Application Data

(60) Provisional application No. 60/975,898, filed on Sep. 28, 2007.

(51) Int. Cl.
*F41A 3/86* (2006.01)

(52) U.S. Cl. ..... 89/196; 42/14; 42/15; 42/16; 42/25; 42/46

(58) Field of Classification Search ..... 89/196; 42/25, 46, 47
See application file for complete search history.

(56) References Cited

U.S. PATENT DOCUMENTS 3,857,322 A * 12/1974 Lichtman ..... 89/145
3,967,404 A * 7/1976 Reynolds ..... 42/25
4,549,465 A * 10/1985 Charron ..... 89/196
4,627,184 A * 12/1986 Ruger et al. ..... 42/25
5,024,016 A * 6/1991 Smith ..... 42/25
5,608,981 A * 3/1997 Canaday ..... 42/25
5,678,340 A * 10/1997 Moon ..... 42/25
5,741,996 A * 4/1998 Ruger et al. ..... 89/196
5,794,373 A * 8/1998 Moon ..... 42/25
5,835,978 A * 11/1998 Canaday et al. ..... 89/138
6,442,882 B1 * 9/2002 Dionne ..... 42/77
6,513,273 B2 * 2/2003 da Silveira ..... 42/70.08

(Continued)

FOREIGN PATENT DOCUMENTS

FR 2 515 333 A1 4/1983

(Continued)

OTHER PUBLICATIONS

Corresponding PCT Application PCT/US2008/075774 Preliminary Report Apr. 8, 2010 (6 pages) and Search Report with Written Opinion Nov. 21, 2008 (8 pages).

(Continued)

*Primary Examiner* — Michael Carone
*Assistant Examiner* — Samir Abdosh
(74) *Attorney, Agent, or Firm* — Duane Morris LLP; Frank J. Spanitz

(57) ABSTRACT

A slide catch-ejector assembly for an autoloading firearm. An embodiment of a firearm having a slide catch-ejector assembly includes a housing, a slide slidably mounted on the housing for rearward and forward axial movement, and an assembly having a slide catch portion configured for engaging the slide and an ejector portion configured for ejecting cartridge casings from the firearm. In one embodiment, the assembly is selectively movable in the housing between a deactivated position in which the slide catch portion is not engageable with the slide and an activated position in which the slide catch portion is engageable with the slide. The ejector portion is selectively movable into and out of axial alignment with a chamber that receives a cartridge via moving the assembly between the deactivated and activated positions.

19 Claims, 14 Drawing Sheets

U.S. PATENT DOCUMENTS

| | | | | |
|---|---|---|---|---|
| 7,103,998 | B2 * | 9/2006 | McGarry | 42/16 |
| 7,337,570 | B1 * | 3/2008 | McGarry | 42/16 |
| 7,337,571 | B2 * | 3/2008 | McGarry | 42/16 |
| 7,343,706 | B2 * | 3/2008 | McGarry | 42/16 |
| 2005/0115127 | A1 * | 6/2005 | Szabo | 42/46 |
| 2006/0185212 | A1 * | 8/2006 | Curry et al. | 42/46 |
| 2007/0012170 | A1 * | 1/2007 | Spielberger | 89/196 |
| 2009/0071053 | A1 * | 3/2009 | Thomele et al. | 42/1.01 |
| 2010/0242329 | A1 * | 9/2010 | Carr et al. | 42/14 |
| 2010/0242330 | A1 * | 9/2010 | Carr et al. | 42/14 |
| 2010/0242331 | A1 * | 9/2010 | Carr et al. | 42/16 |

FOREIGN PATENT DOCUMENTS

| | | |
|---|---|---|
| GB | 391 274 A | 4/1933 |

OTHER PUBLICATIONS

KEL-TEC P-3AT Pistol Safety, Instruction and Parts Manual, KEL-TEC CNC Industries Inc., Jul. 2005, 16 pages.

Corresponding European patent Application No. EP 08 79 9381.2 supplementary European search report of Mar. 10, 2011.

* cited by examiner

FIG. 5A
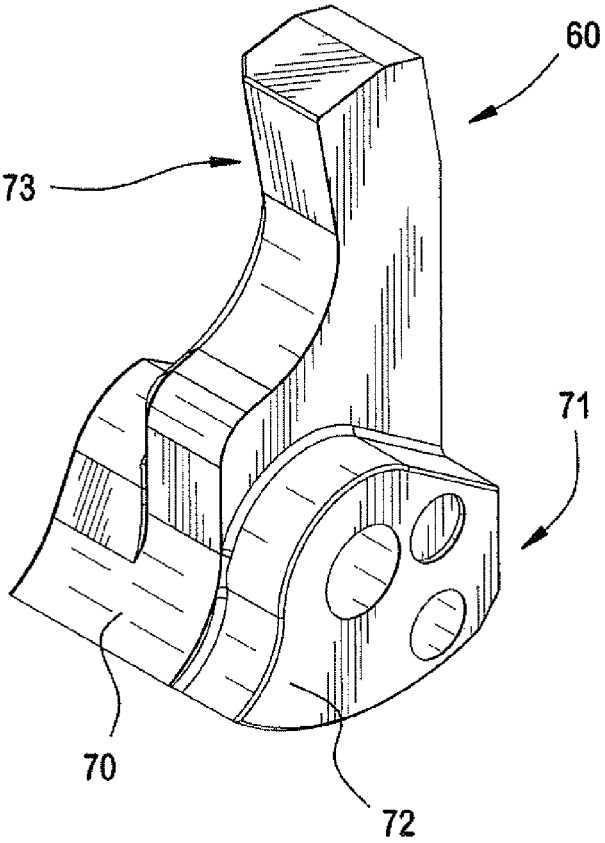
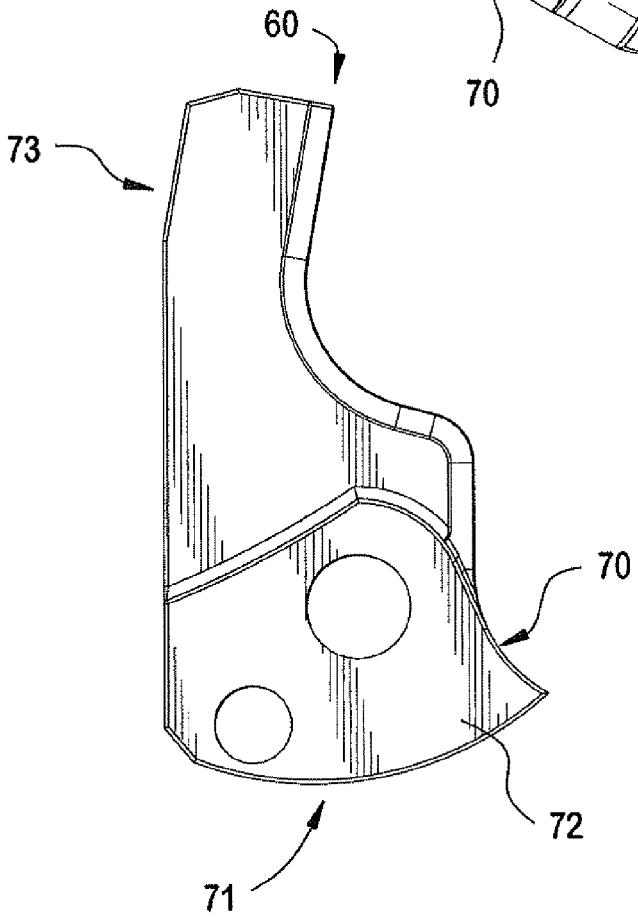
FIG. 5B

SLIDE CATCH-EJECTOR ASSEMBLY FOR FIREARM

CROSS-REFERENCE TO RELATED APPLICATIONS

This application claims the benefit of priority to U.S. Provisional Application No. 60/975,898 filed Sep. 28, 2007, which is incorporated herein by reference in its entirety.

BACKGROUND OF THE INVENTION

The present invention generally relates to firearms, and more particularly to a slide catch and ejector assembly for autoloading pistols.

Subcompact firearms, such as semiautomatic autoloading pistols for concealed carry applications, present numerous design challenges due to the need to provide essentially the same functionality as full-size pistols, but in a relatively small physical package. Some subcompact pistols may have typical lengths between about 5-6 inches and weigh less than one pound in contrast to their longer and heavier full-size counterparts. Accordingly, it is desirable to minimize size and weight of these subcompact pistols to facilitate concealed carry by keeping the number of components required for a fully-functional pistol to minimum without sacrificing functionality and safety. Therefore, efficient use of limited available space which is at a premium is essential to providing lightweight and compact pistols suitable for concealed carry.

According to another aspect of full-size autoloading pistols, slide catch or hold mechanisms for holding the slide in an open position are known to facilitate inspection of the breech area of the pistol. Accordingly, a slide catch is desired that can be spatially and efficiently accommodated in the limited space available in a subcompact pistol format.

SUMMARY OF THE INVENTION

According to another aspect of the invention, a firearm such as a subcompact firearm is provided that includes a mechanism with the dual functionality of a slide hold or catch and a cartridge casing ejector. The single combination slide catch-ejector assembly functions to both (1) hold the slide open to expose the breech area for inspection and/or disassembling the firearm, and (2) eject spent or loaded cartridge casings from the firearm after discharge. In one embodiment, a subcompact firearm with combination slide catch-ejector assembly includes a slide catch for holding a slide in a first position, and an ejector conjoined to the slide catch for ejecting cartridge casings from the firearm.

In one embodiment, a firearm with slide catch-ejector assembly includes, a housing, a slide movably mounted on the housing for rearward and forward axial movement, and an assembly having a slide catch portion configured for engaging the slide and an ejector portion configured for ejecting cartridge casings from the firearm. The assembly is selectively movable in the housing between a deactivated position in which the slide catch portion is not engageable with the slide and an activated position in which the slide catch portion is engageable with the slide. In one embodiment, the ejector portion defines a cartridge striking surface that is movable into and out of axial alignment with a chamber that receives a cartridge via moving the assembly between the deactivated and activated positions. In another embodiment, the ejector portion is axially aligned with the chamber when the assembly is in the deactivated position.

In another embodiment, a firearm with slide catch includes a housing, a slide movably mounted on the housing for rearward and forward axial movement, a barrel disposed at least partially in the slide and defining a chamber for receiving a cartridge, and a slide catch movably disposed in the housing for holding the slide in a rearward position on the frame. The slide catch includes an outwardly-projecting ejector selectively movable from a first non-ejecting position to a second operating position via moving the slide catch, the ejector being axially aligned with the chamber when in the operating position to eject cartridge casings from the firearm. In one embodiment, the ejector is not axially aligned with the chamber when in the non-ejecting position. In some embodiment, the slide catch is selectively movable between a deactivated position in which the slide catch is not engageable with the slide and an activated position in which the slide catch portion is engageable with the slide. In one embodiment, the slide catch is engageable with a cutout in the slide.

In one embodiment, a slide catch-ejector assembly is provided for a firearm having a housing, a slide movably disposed on the housing for rearward and forward movement, and a barrel defining a chamber that receives a cartridge. The slide catch-ejector assembly includes a first slide catch portion defining a slide abutment surface configured to engage a cutout in the slide for holding a breech area of the firearm open, a second ejector portion defining a cartridge striking surface configured to contact a cartridge casing extracted from the chamber for ejecting the casing from the firearm, and a grip configured for operating the slide catch-ejector assembly by a user. The cartridge striking surface may face in an opposite direction from the slide abutment surface in one embodiment.

In another embodiment, a firearm with slide catch includes a housing, a slide movably mounted on the housing for rearward and forward axial movement, a barrel disposed at least partially in the slide and defining a chamber for receiving a cartridge, a slide catch configured for engaging the slide and slidable in the housing between a deactivated position in which the slide catch is not engageable with the slide and an activated position in which the slide catch portion is engageable with the slide, and an ejector configured for ejecting cartridge casings from the firearm and movable between an operating position in which the ejector is axially aligned with the chamber to eject cartridge casings from the firearm and a non-ejecting position in which the ejector is not axially aligned with the chamber. The slide catch operatively cooperates with the ejector such that moving the slide catch from the deactivated position to the activated position simultaneously moves the ejector from the operating position to the non-ejecting position. In one embodiment, the ejector is conjoined to the slide catch and movable simultaneously therewith.

A method of using a slide catch-ejector assembly in a firearm is also provided. In one embodiment, the method includes: providing a firearm having a housing, a slide slidably mounted on the housing for forward and rearward movement, a barrel defining a chamber for holding a cartridge, the barrel and slide defining a closed breech area therebetween, and a slide catch slidably disposed in the housing and defining an ejector being axially aligned with the chamber and operative to eject cartridge casings from the firearm after discharging the firearm; sliding the slide rearwards on the housing to open the breech area; sliding the slide catch; engaging the slide with the slide catch to hold the breech area open; and simultaneously moving the ejector out of alignment with the chamber via sliding the slide catch. In one embodiment, the sliding step includes sliding the slide catch vertically upwards in the housing. In another embodiment, sliding the slide catch moves the slide catch and ejector vertically upwards in the housing together.

BRIEF DESCRIPTION OF THE DRAWINGS

The features of the preferred embodiments will be described with reference to the following drawings where like elements are labeled similarly, and in which:

FIG. 5A is a perspective view of the hammer of the pistol of FIG. 1;

FIG. 5B is a left side view of the hammer of the pistol of FIG. 1;

DESCRIPTION OF PREFERRED EMBODIMENTS

Figure 1:
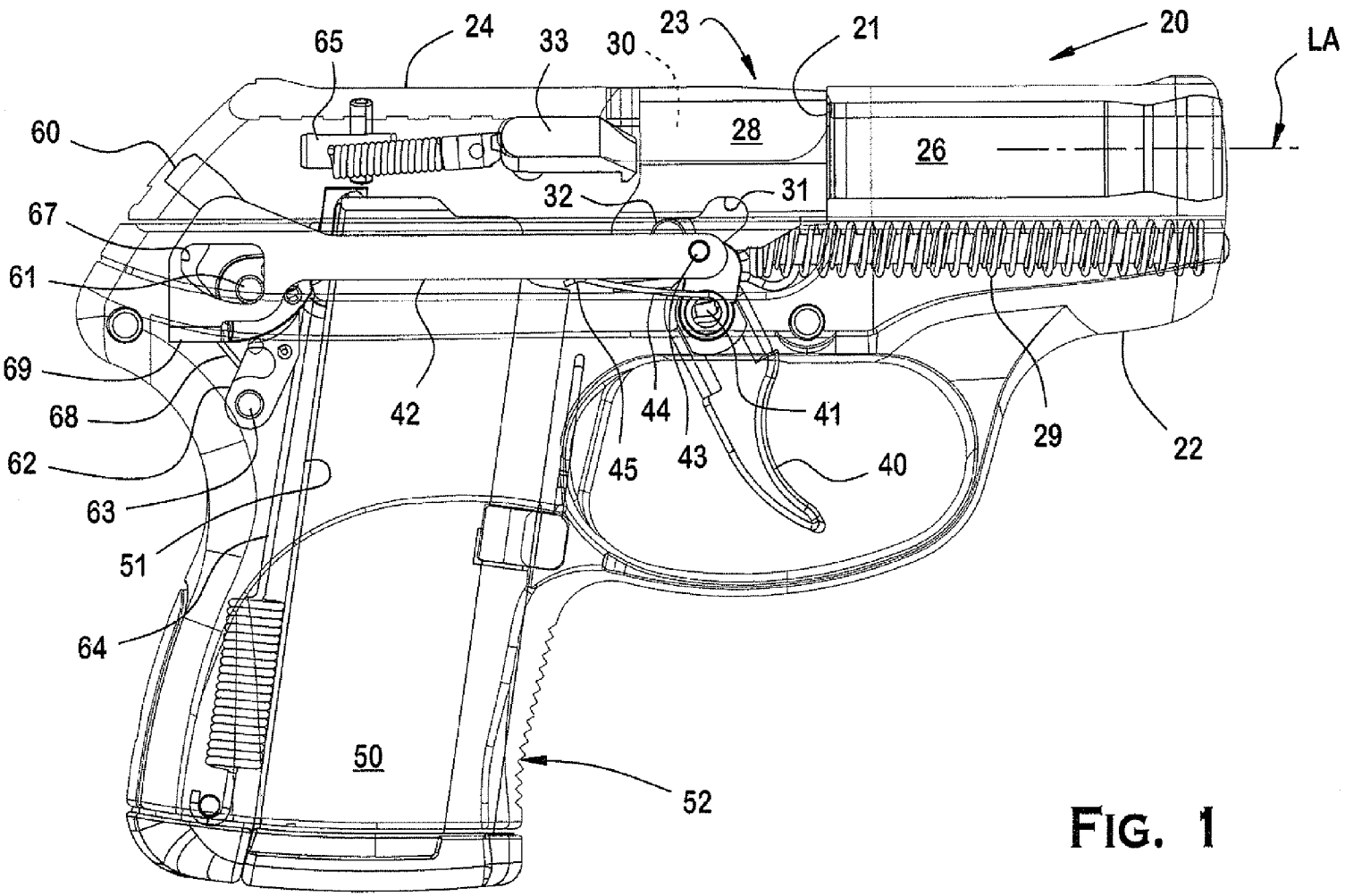
FIG. 1 is a right side view of one embodiment of a subcompact pistol showing the internal firing control mechanism.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

A preferred embodiment of a firearm will now be described for convenience with reference to a semi-automatic subcompact pistol. The principles and features of the preferred embodiment disclosed herein, however, may be used with equal benefit for other types of firearms, such as full size pistols and rifles. Accordingly, the invention is not limited for use with subcompact pistols alone.

Figure 2:
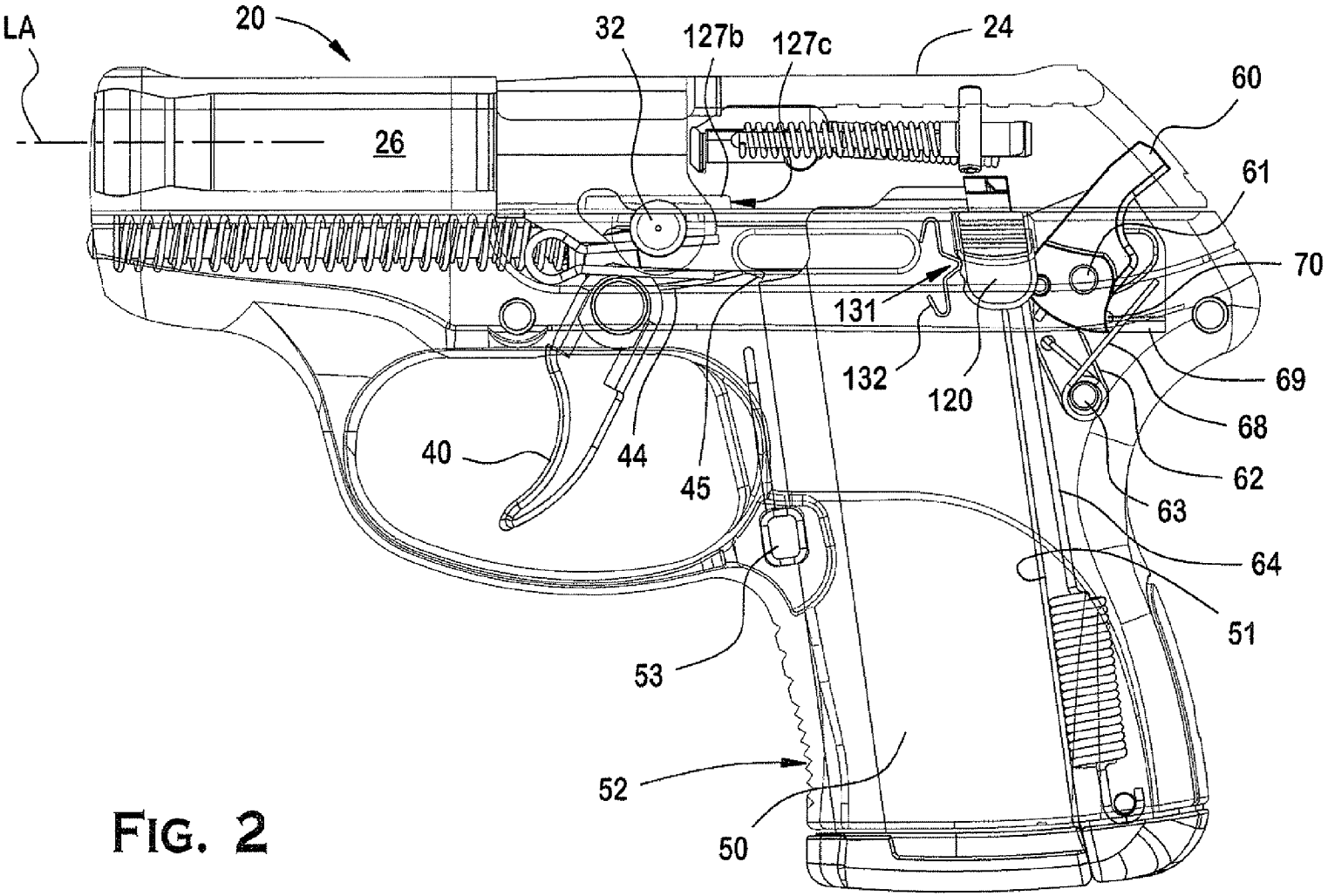
FIG. 2 is a left side view of the pistol of FIG. 1.
Figure 3:
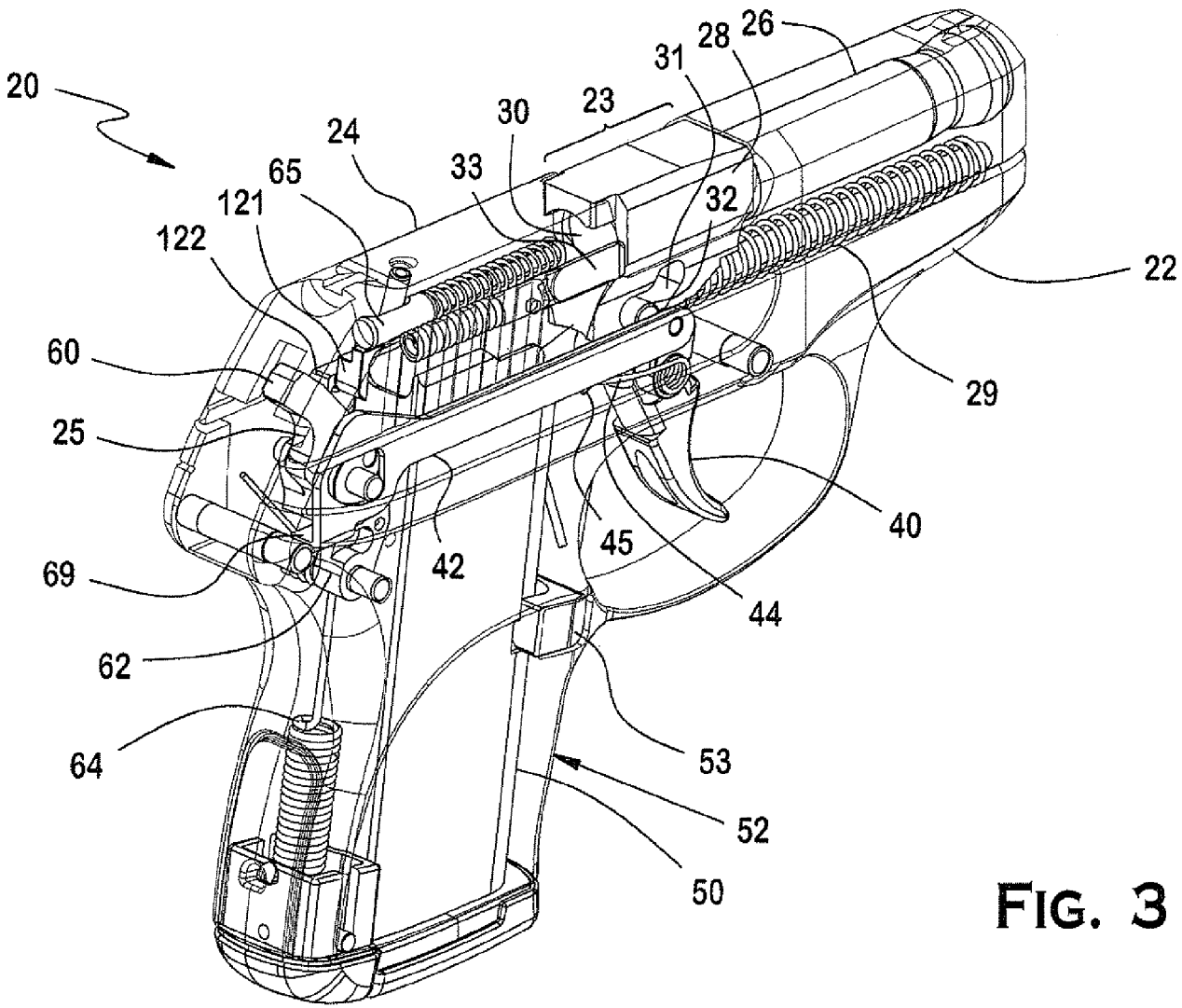
FIG. 3 is a rear perspective view of the pistol of FIG. 1.
Figure 6A:
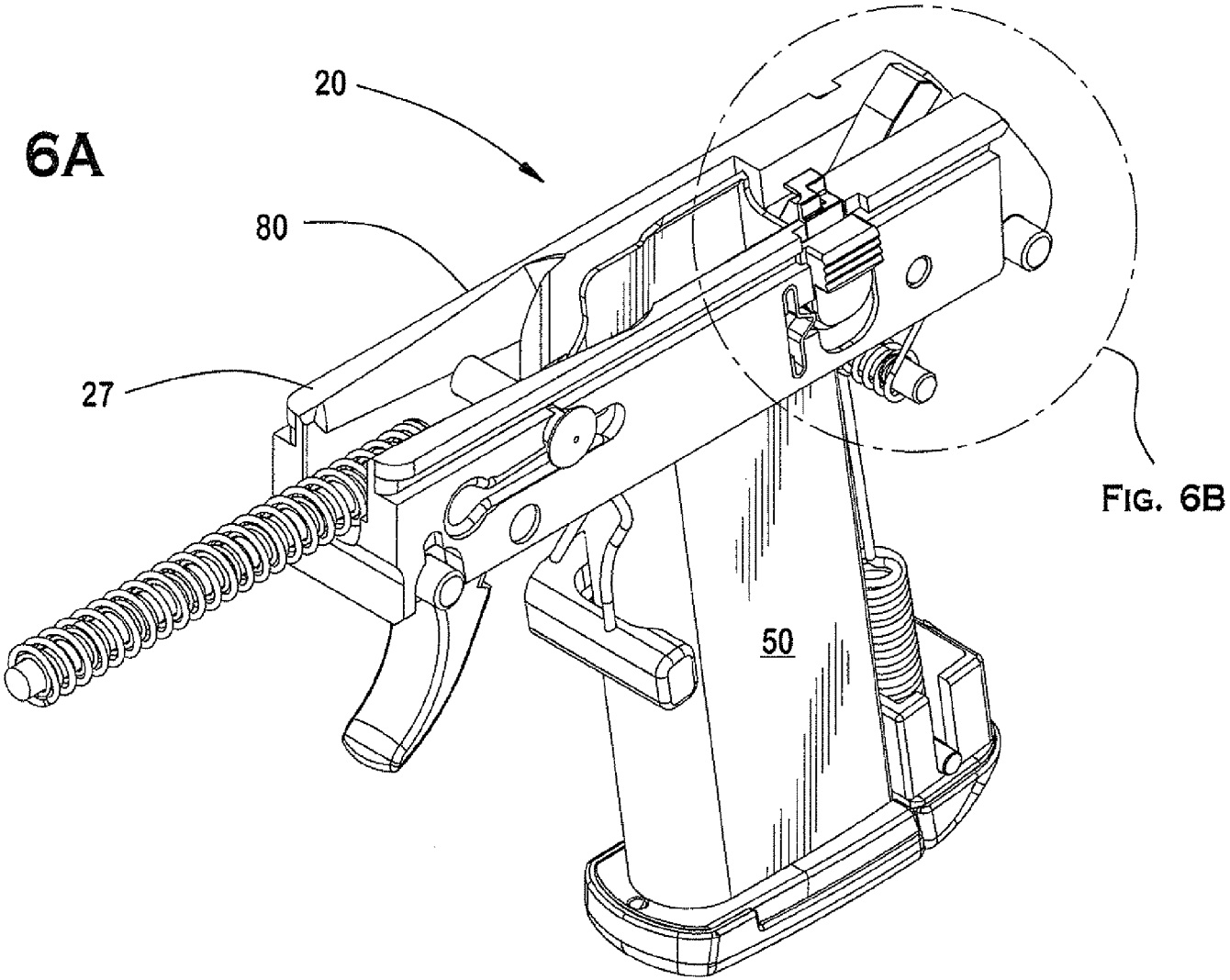
FIG. 6A is a perspective view of the firing control mechanism and housing of the pistol of FIG. 1.
Figure 6B:
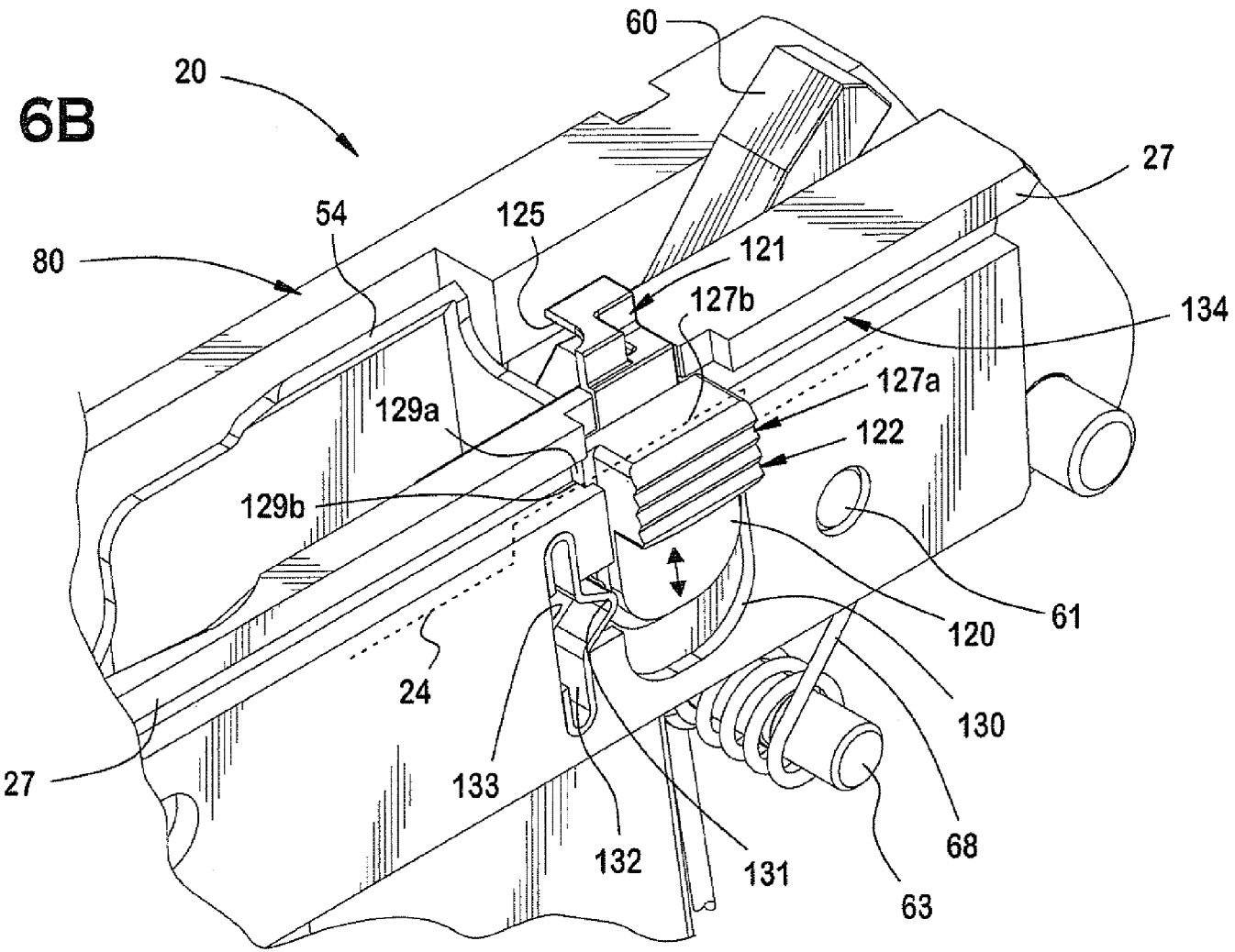
FIG. 6B is a close-up perspective view taken from FIG. 6A of the rear of the firing control housing of the pistol of FIG. 1 showing the slide catch-ejector in an activated position.

FIGS. 1 and 2 show right and left side views of a subcompact pistol 20 with firing control mechanism. FIG. 3 shows a rear perspective view of the same pistol 20. These foregoing figures show the pistol frame and slide in phantom view to better reveal the firing control mechanism. FIG. 6A shows a firing control housing 80 and the firing control housing components. FIG. 6B is a close-up view of firing control housing 80 taken from FIG. 6A.

Referring to FIGS. 1-3 and 6A-B, a subcompact pistol 20 includes a grip frame 22 and firing control housing 80 mounted therein that supports a plurality of firing control mechanism components as further described herein. A slide 24 is slidably mounted on firing control housing 80 via a conventional support rail and slide groove system for axial movement forwards and rearwards thereon. Slide 24 includes a pair of spaced-apart longitudinally-extending grooves 25 (see FIG. 3) that receive corresponding longitudinally-extending rails 27 on firing control housing 80 (see FIGS. 6A and 6B). Recoil spring 29 is operably associated with slide 24 and acts to return the slide forward to the position shown in FIGS. 1-3 after discharging pistol 20.

Pistol 20 further includes a barrel 26 that is movably disposed at least partially inside slide 24 and which includes a rear chamber block 28 defining an open chamber 30 therein for receiving a cartridge and breech area 23 located behind the chamber in slide 24. Barrel 26 further defines a longitudinal axis LA for pistol 20. Barrel 26 is moveable rearwards with slide 24 on firing control housing 80 in a conventional manner. Barrel 26 includes a conventional cam track or slot 31 configured to engage a corresponding camming cross pin 32 mounted transversely in frame 22 for arresting the rearward movement of the barrel after discharging pistol 20 (not shown). Cross pin 32 limits and stops rearward movement of barrel 26 after traveling a relatively short distance rearwards upon discharging pistol 20. This allows slide 24 to continue moving rearwards alone, thereby opening breech area 23 so that a spent cartridge casing may extracted from chamber 30 by extractor 33 and ejected from pistol 20 by slide catch-ejector assembly 120 through ejector port 21 in the slide. Thereafter, recoil spring returns slide 24 forward stripping a new cartridge from a magazine 50 and inserting the cartridge into chamber 30. Breech area 23 is re-closed and both slide 24 and barrel 26 are brought forward together to the ready-to-fire position shown in FIGS. 1-3.

With reference to FIGS. 1-3, 5A-B, and 6A-B, a firing control mechanism in one embodiment includes trigger 40 pivotally mounted to firing control housing 80 via transverse pin 41, trigger bar 42 pivotally coupled to the trigger via transverse pin 43, hammer 60 pivotally mounted to firing control housing 80 via transverse pin 61, hammer stop 62 pivotally mounted to grip frame 22 via transverse pin 63 and engageable with the hammer, and spring-loaded firing pin 65 supported by slide 24 and positioned to be contacted by the hammer and driven forward to strike a chambered cartridge in a conventional manner. Hammer spring 64, which in one embodiment may be a tension spring as shown, has a portion that connects to a lower portion of hammer 60 forward of pin 61 and biases the hammer forward towards firing pin 65. Trigger spring 44, which in one embodiment may be a torsion spring as shown, is mounted about pin 41 and biases trigger 40 toward the fully forward ready-to-fire position shown in FIGS. 1-3. Trigger spring 44 further includes a rearwardly and laterally-extending leg 45 which acts on the underside of trigger bar 42 (best shown in FIG. 3) to bias the trigger bar upwards towards engagement with hammer 60.

Although the foregoing firing control mechanism has been described with reference to a hammer which strikes the firing pin to discharge the pistol, in other embodiments contemplated the firing control housing may alternatively include an axially-movable striker that incorporates or contacts a firing pin for discharging the invention. Accordingly, the magazine disconnect mechanism according to the invention is not limited to hammer-actuated pistols or firearm alone.

With continuing reference to FIGS. 1-3, trigger bar 42 may be a generally flat and relatively thin plate-like structure having an elongated configuration. In one embodiment, the rear portion of trigger bar 42 may be enlarged and further defines a window 67 which receives hammer pin 61 therein. Window 67 interacts with hammer pin 61 to provide a vertical stop for limiting the upward position of trigger bar 42 under the biasing force of trigger spring 44 via a lower portion of window engaging the hammer pin as shown in FIG. 1.

To operably engage hammer 60 for cocking and releasing the hammer to discharge pistol 20, trigger bar 42 in one embodiment includes a laterally-extending portion such as trigger bar protrusion 69 as shown in FIGS. 1-3. In one embodiment, trigger bar protrusion 69 may be configured as a generally flat flange projecting laterally inwards from trigger bar 42 when mounted in the pistol (see FIG. 4). Trigger bar protrusion 69 is configured and positioned to engage a portion of hammer 60. In one embodiment, trigger bar protrusion 69 engages an operating portion 72 which may be located on a lower portion 71 of hammer 60 (see FIGS. 5A & 5B). Operating portion 72 may include a rear engaging surface 70 in a preferred embodiment (see FIGS. 5A & B) which is engaged by trigger bar protrusion 69. In one embodiment, rear surface 70 may be concave in shape thereby forming an arcuate hook on operating portion 72 of hammer 60. This provides smooth movement and release of hammer 60 when operably engaged and cocked by trigger bar 42. Hammer 60 further includes an upper striking portion 73, which may be lever shaped in one embodiment, and is positioned and operable to strike the rear of firing pin 65.

Hammer stop 62 preferably is biased into engagement with hammer 60 by hammer stop spring 68 mounted about hammer stop pin 63 as shown in FIGS. 1-3. When hammer 60 is cocked in the ready-to-fire position shown in FIGS. 1-3, hammer stop 62 preferably is engaged with hammer 60. Hammer stop 62 holds hammer 60 in the cocked position and prevents the hammer from being released in the absence of a trigger pull.

Operation of the firing control mechanism will now be described. Starting with pistol 20 in the ready-to-fire position shown in FIGS. 1-3, hammer 60 is shown cocked rearwards with upper striking lever portion 73 being aligned to strike but spaced apart from firing pin 65. Lateral trigger bar protrusion 69 of trigger bar 42 is axially aligned with rear surface 70 of hammer 60 (see also FIG. 4). Pulling trigger 40 causes the trigger to rotate forwards about trigger pin 41 and similarly pulls trigger bar 42 axially forward. As trigger bar 42 moves forward, trigger bar protrusion 69 engages rear surface 70 of hammer 60 below pin 61 to rotate and cock the hammer rearwards. Trigger bar protrusion 69 continues forward to contact and disengage hammer stop 62 from hammer 60 and holds the hammer stop in a forward position while releasing the hammer. Hammer 60 rotates forward under the biasing force of hammer spring 64 and strikes the rear of firing pin 65, driving the firing pin forward to strike a chambered cartridge and discharge pistol 20. After discharging pistol 20, the firing control mechanism returns to the ready-to-fire position shown in FIGS. 1-3 in a conventional manner under the biasing force of recoil spring 29.

According to one aspect of a preferred embodiment, pistol 20 includes a multi-functional combination slide catch-ejector assembly 120 having a first portion configured for holding the slide open to expose the breech area 23 for inspection and a second portion configured for ejecting cartridge casings from the pistol. Referring to FIGS. 2, 6A-B, and 7A-D, a combination slide catch-ejector assembly 120 is slidably received for selective vertical movement in a slot 130 formed in firing control housing 80. Slot 130 is configured to complement the shape of slide catch-ejector assembly 120 shown in FIGS. 7A-D in detail. Preferably, slot 130 is sized in height to provide a vertical range of motion for the slide catch-ejector between a first upper activated position and a second lower deactivated position.

With continuing reference to FIGS. 2, 6A-B, and 7A-D, a preferred embodiment of a slide catch-ejector assembly 120 includes a detent mechanism such as one including a biasing member which is provided to retain slide catch-ejector assembly 120 in either the upper or lower positions. In one embodiment, the biasing member may be a detent spring 132 that is configured to engage slide catch-ejector assembly 120. Detent spring 132 is disposed in a complementary-shaped receptacle 133 defined by firing control housing 80 that includes an opening which communicates with recess 130 wherein slide catch-ejector assembly 120 is disposed, thereby allowing the spring to engage a portion of the slide catch-ejector assembly. In one embodiment, detent spring 130 may be a configured bar spring that is shaped to include a nose 131 that alternatingly engages one of a pair of complementary-shaped detent notches 124 formed in a side of slide catch-ejector assembly 120 as shown in FIGS. 7A-D. In alternative embodiments of a detent mechanism, a conventional spring-loaded detent plunger or ball (not shown) or other conventional types of detent mechanisms may be substituted for detent spring 132.

Figure 7A:
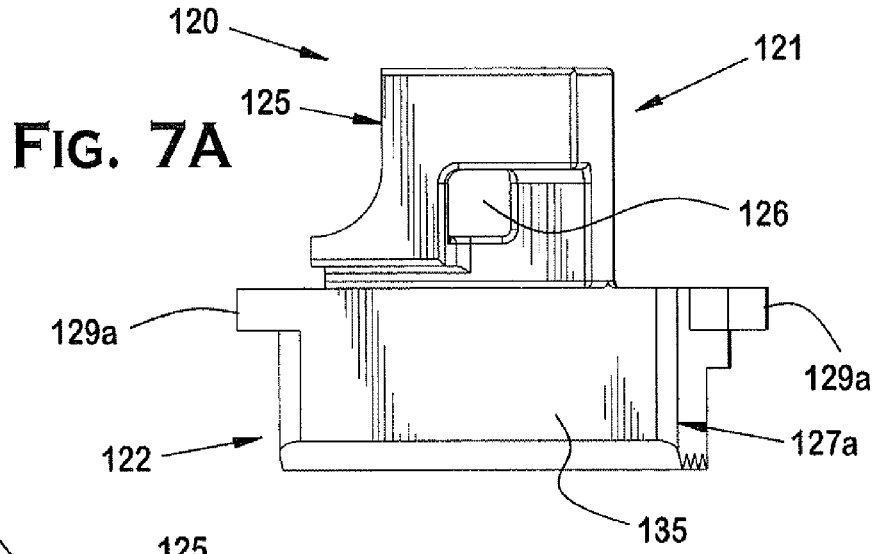
FIGS. 7A-D show various views of the slide catch-ejector of FIGS. 6A & B.
Figure 7B:
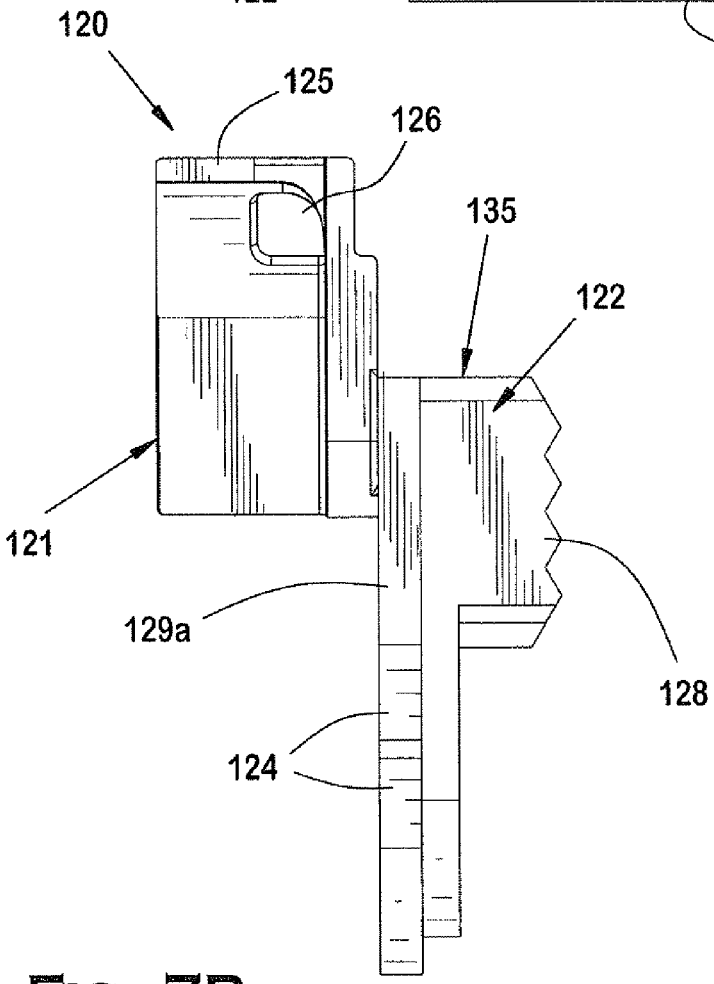
Figure 7C:
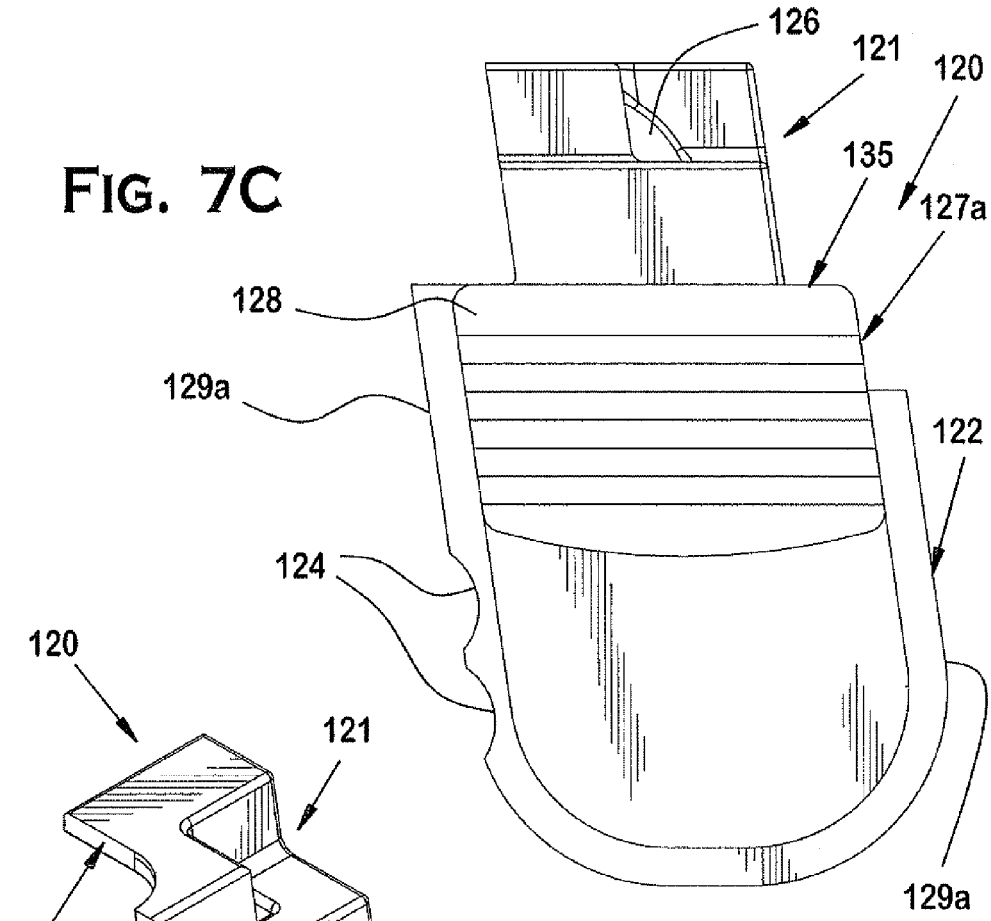
Figure 7D:
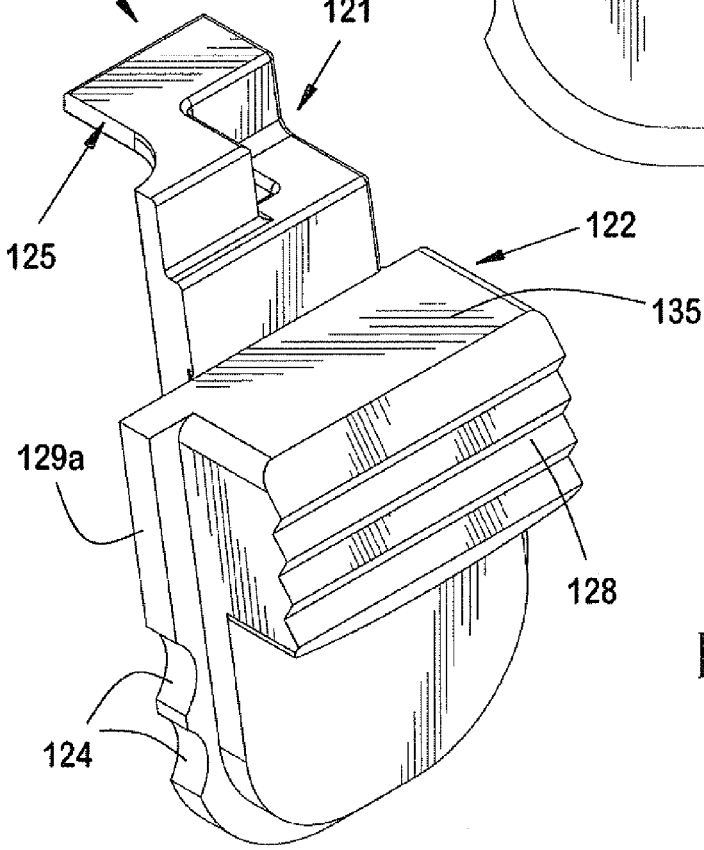

FIGS. 7A-D shows various views of the slide catch-ejector assembly 120. FIG. 7A is a top view of slide catch-ejector assembly 120. FIG. 7B is a front view thereof. FIG. 7C is a left side view thereof. FIG. 7D is a perspective view thereof Referring to FIGS. 7A-D, slide catch-ejector assembly 120 in one embodiment includes an ejector 121 and conjoined slide catch 122. Ejector 121 and slide catch 122 are each configured for their respective functions, but advantageously are combined into a dual-purpose single part to efficiently use the limited space available in subcompact pistol formats. Ejector 121 and adjoining slide catch 122 preferably are formed together as integral parts of slide catch-ejector assembly 120, but may also be separate components which are joined or coupled together by any suitable mechanical means commonly used in the art such as without limitation welding. In some embodiments, as best shown in FIGS. 7A-D and 10A-E, ejector 121 may be generally configured as a flange that projects outward from slide catch 122 such that the ejector extends laterally inward towards longitudinal axis LA when slide catch-ejector assembly 120 is mounted in housing 22 for aligning with chamber 30.

Figure 4:
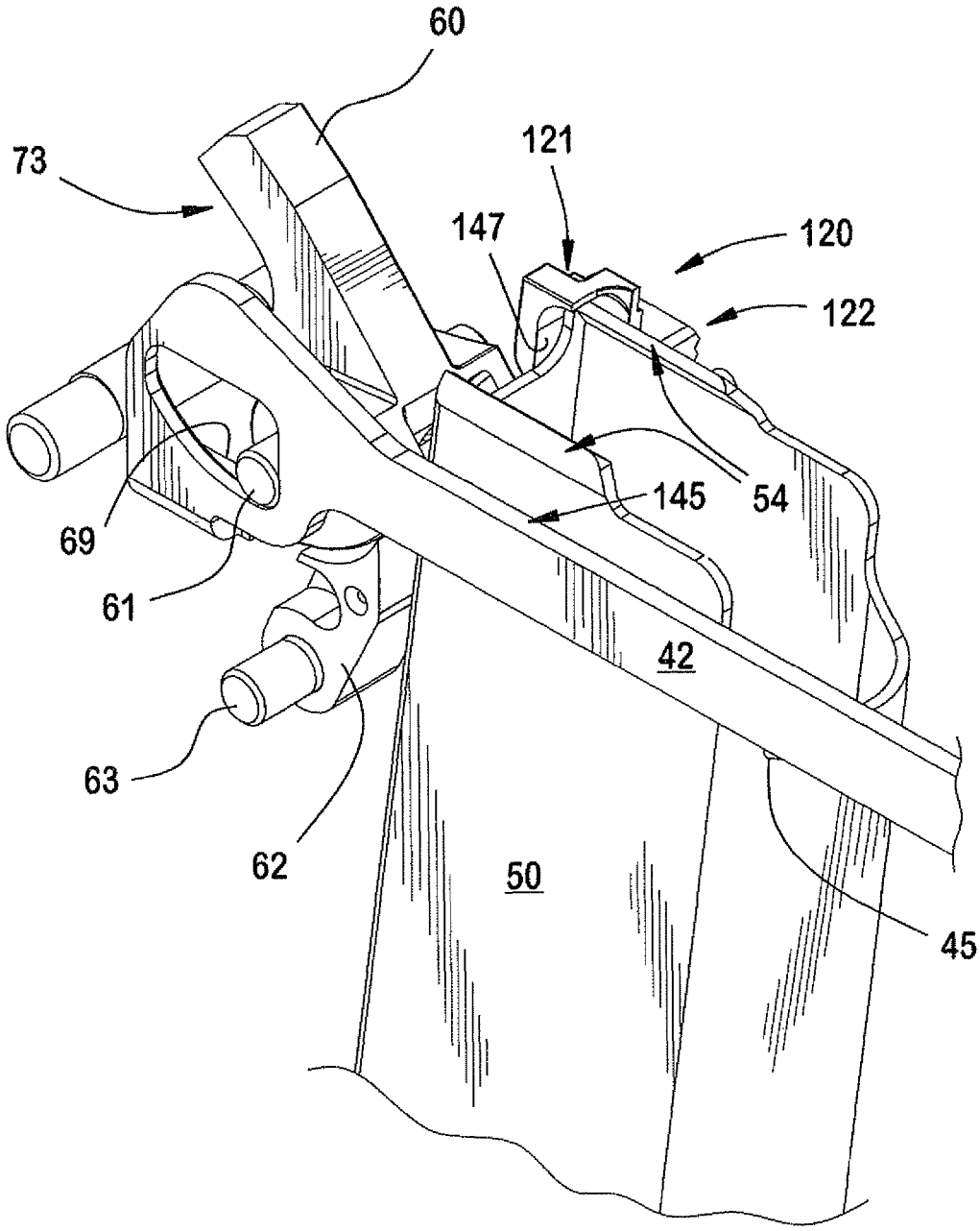
FIG. 4 is a close-up perspective view of the rear of the firing control mechanism of the pistol of FIG. 1.

Ejector 121, forming one portion of slide catch-ejector assembly 120, is movable and selectively positionable by a user (unlike some conventional fixed ejector designs) for axial alignment with barrel chamber 30 and a cartridge when loaded in the chamber for ejecting a spent cartridge casing from pistol 20. Ejector 121 is vertically movable between an upper non-ejecting position shown in FIG. 6B and an operating position shown in FIG. 9. Accordingly, in one embodiment ejector 121 is configured for contacting a cartridge casing and includes a cartridge striking surface 125. When slide catch-ejector assembly 120 is in the lower deactivated position with ejector 121 in the operating position (similar to that shown in FIG. 9), cartridge striking surface 125 is preferably positioned with respect to firing control housing 80 to contact and eject a cartridge or casing extracted from chamber 30 by extractor 33 (see FIG. 1) in a conventional manner after firing the pistol. To provide this proper positioning, ejector 121 is configured so that cartridge striking surface 125 is located higher on slide catch-ejector assembly 120 than slide abutment surface 127*a* (see FIGS. 7A-D). Ejector 121 may include a cutout 126 and is further configured so that the ejector can be moved upwards in slide 24 without being blocked by structures located inside the slide near the breech area. Many known ejector designs which attach directly to a firing control housing remain stationary and are not movable by the user, and therefore do not require similar cutouts or special configurations like movable ejector 121. To further allow ejector 121 to be fit in the tight physical package of a subcompact pistol, the ejector is preferably configured in one embodiment with a recess 147 shaped to receive an upper rear corner of magazine 50 as shown in FIG. 4 when the ejector is in a downward operating position shown in FIG. 9.

With continuing reference to FIGS. 7A-D, slide catch-ejector assembly 120 includes a serrated thumb/finger grip 128 for operating the assembly. A pair of longitudinally- and vertically-extending ears 129*a* are formed on each side of slide catch-ejector assembly 120 in one embodiment, which are received in complementary-configured recesses 129*b* formed on opposite sides of slot 130 in firing control housing 80 (best shown in FIG. 6B). Ears 129*a* are vertically slidable in recesses 129*b*. In one embodiment, decent notches 124 may be formed in one of the ears 129*a*. Slide catch-ejector assembly 120 further defines a rear facing slide abutment surface 127*a* disposed on a rear portion of the assembly. In one embodiment, surface 127*a* is formed on slide catch 122. Surface 127*a* is configured to engage a front facing rear surface of an elongated cutout 127*b* formed in a lower side of slide 24 as best shown in FIG. 2 (and in phantom lines in FIG. 6B). Preferably, slide abutment surface 127*a* protrudes laterally outwards beyond firing control housing 80 as shown in FIG. 6B to ensure the slide 24 does not slip out of engagement with slide catch 122 when the slide is held rearwards by the catch against the forward biasing force of recoil spring 29. When slide catch-ejector assembly 120 is in the upper activated position shown in FIG. 6B, a portion of slide catch 122 extends upwards to fill gap 134 formed in firing control housing 80 beneath rails 27. This positions slide catch 122 to engage cutout 127*b* in slide 24 (represented by phantom lines in FIG. 6B) in a conventional manner.

Figure 9:
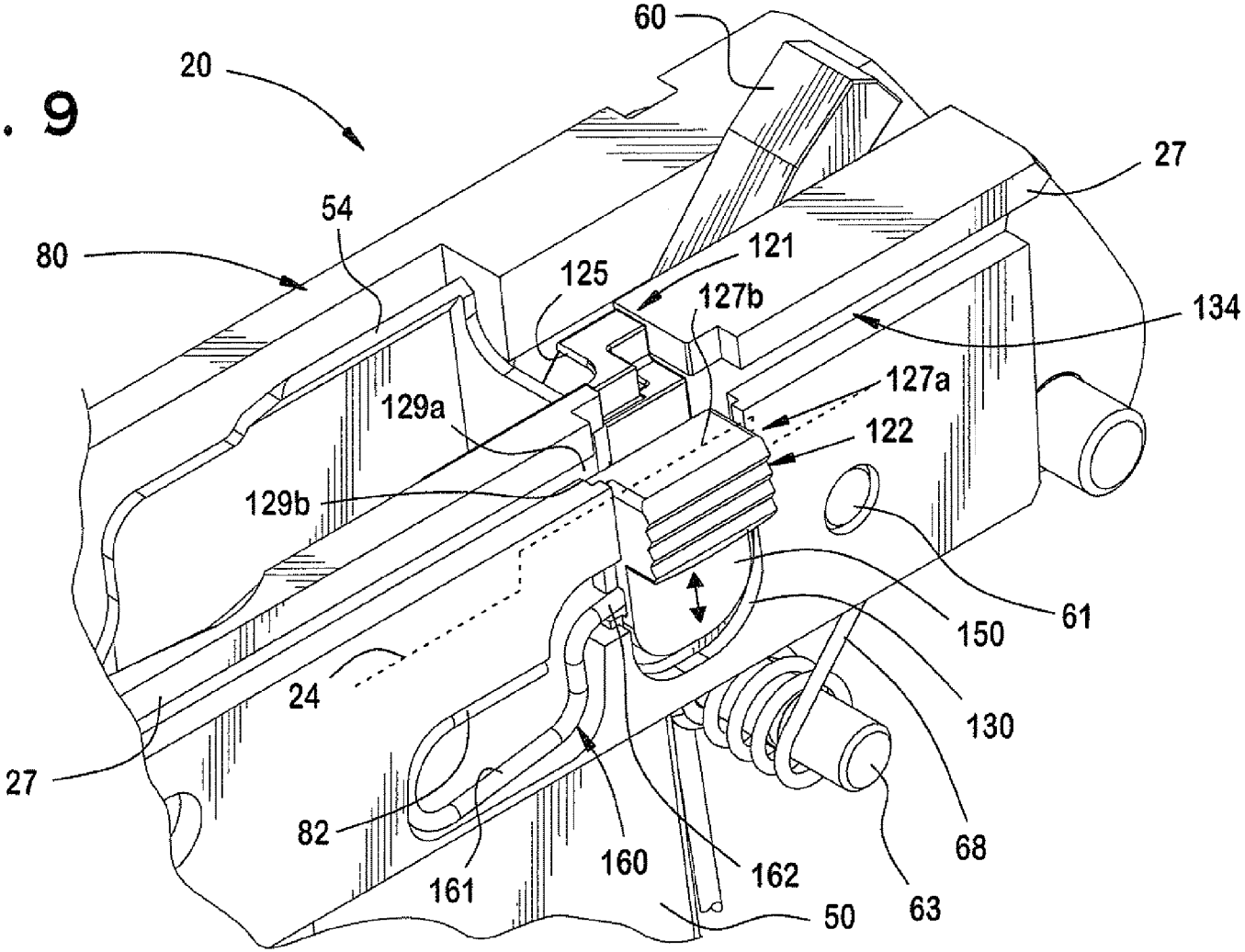
FIG. 9 is a close-up perspective view of the rear of the firing control housing of the pistol of FIG. 1 showing the alternative embodiment of the slide catch-ejector of FIG. 8 in a deactivated position.

Slide catch-ejector assembly 120 is movable between a first upper activated position and a second lower deactivated position as indicated by the directional arrows in FIG. 6B. When pistol 20 is in normal ready-to-fire operating mode, slide catch-ejector assembly 120 preferably would be in the lower position (similar to that shown in FIG. 9) wherein upper surface 135 of slide catch 122 is below gap 134 in firing control housing 80, and slide abutment surface 127*a* is positioned below cutout 127*b* formed in slide 24. Slide 24 is therefore freely movable rearwards and forwards on rails 27 of firing control housing 80 in a usual slide operating manner. Ejector 121 would also be in its normal lower operating position wherein the ejector is positioned and aligned with respect to firing control housing 80 and chamber 30 to contact and eject an extracted spent cartridge casing withdrawn from chamber by extractor 33. In one embodiment, as shown in FIG. 9, the top of ejector 121 is flush with the adjacent top surface of firing control housing 80 when the ejector is in its normal operating position. Nose 131 of detent spring 132 would be engaged with the top detent notch in slide catch-ejector assembly 120 when slide catch-ejector assembly 120 is in the lower deactivated position.

To activate the slide catch 122 for holding the breech area 23 in an open position for inspection as needed, the user first manually retracts the slide rearward on firing control housing 80 from the fully forward position shown in FIGS. 1-3 and aligns slide catch 122 with corresponding cutout 127*b* in the slide 24. Slide catch 122 is then manually pushed upwards to the upper activated position of the slide catch-ejector assembly 120 shown in FIGS. 6A-B wherein the slide catch enters slide cutout 127*b*. Slide 24 is then released by the user so that rear facing slide abutment surface 127*a* on slide catch 122 engages a corresponding front facing rear surface 127*c* (see FIG. 2) in the rear portion of slide cutout 127*b* as best shown in FIG. 6B (showing slide in phantom lines). Slide 24 is thereby held in a rearward position against the forward biasing force of recoil spring 29 to expose the breech area 23. Nose 131 of detent spring 132 would be engaged with the bottom detent notch in slide catch-ejector assembly 120.

To return slide 24 forward, the user holds the slide and manually moves slide catch 122 downwards into the lower deactivated position of slide catch-ejector assembly 120 (not shown). Slide catch 122 concomitantly is removed from slide cutout 127*b* and no longer held rearward. The uses releases slide 24 which returns fully forward under the biasing force of recoil spring 29 to the position shown in FIGS. 1-3, thereby re-closing the breech area 23.

Figure 8:
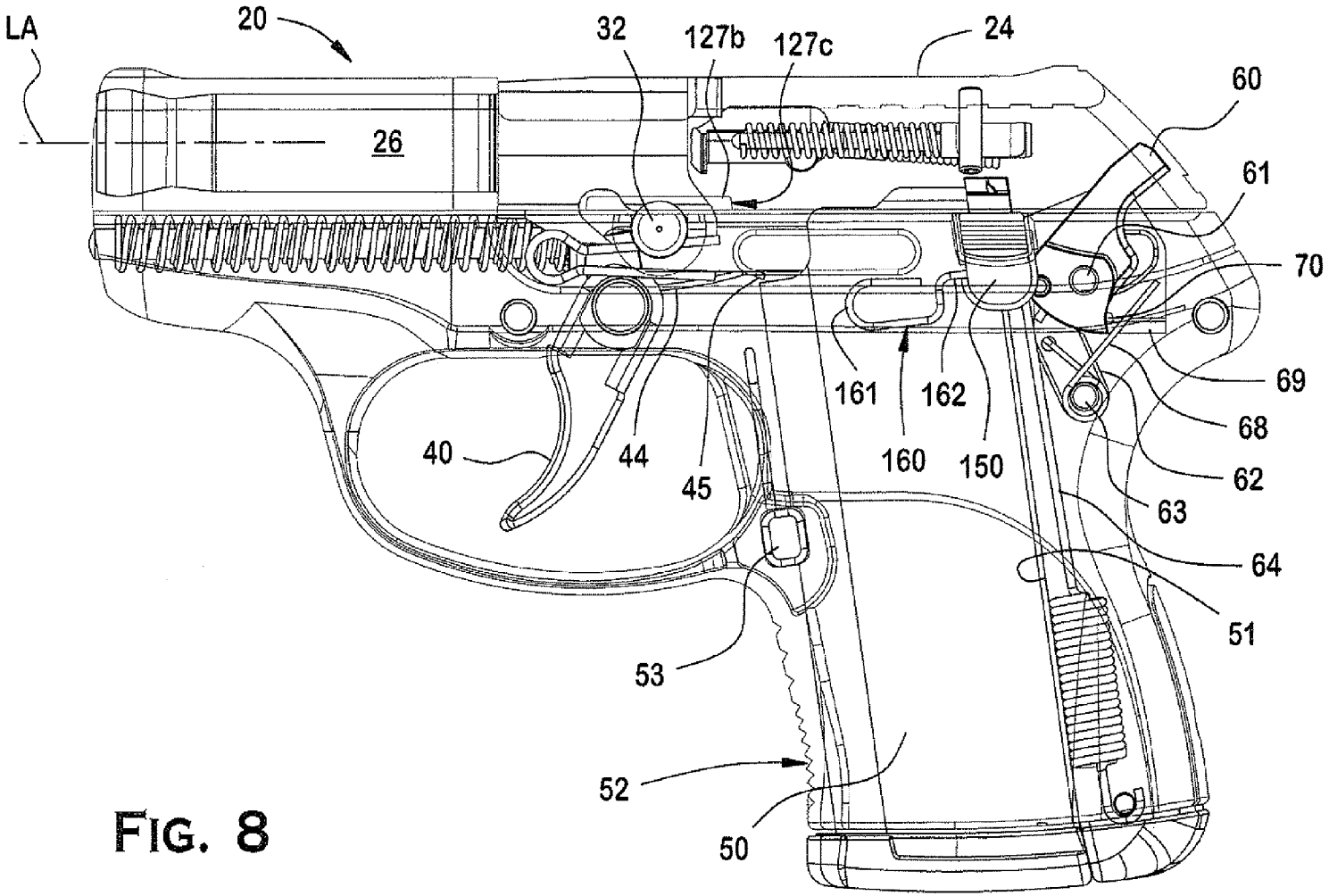
FIG. 8 is a left side view of the pistol of FIG. 1 with an alternative embodiment of a slide catch-ejector.
Figure 10A:
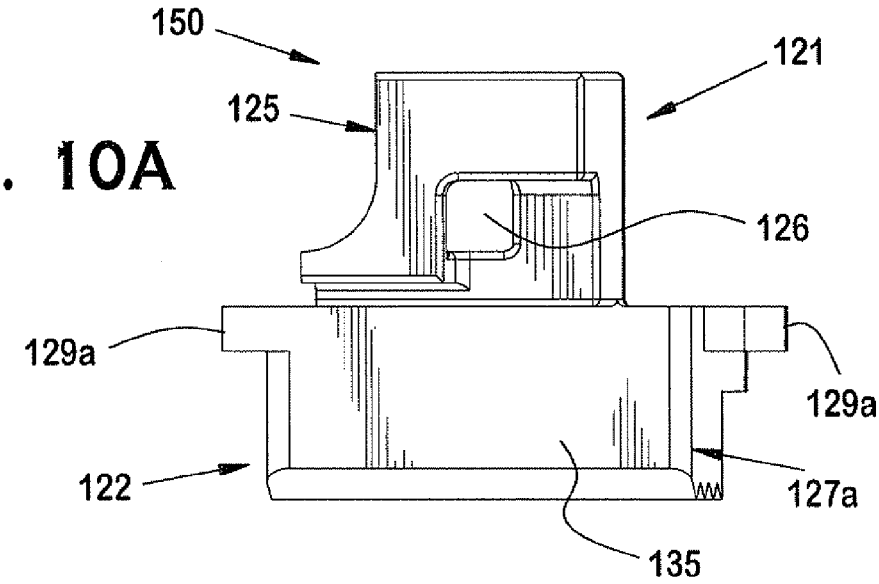
FIGS. 10A-E show various views of the alternative slide catch-ejector of FIGS. 8 and 9.
Figure 10B:
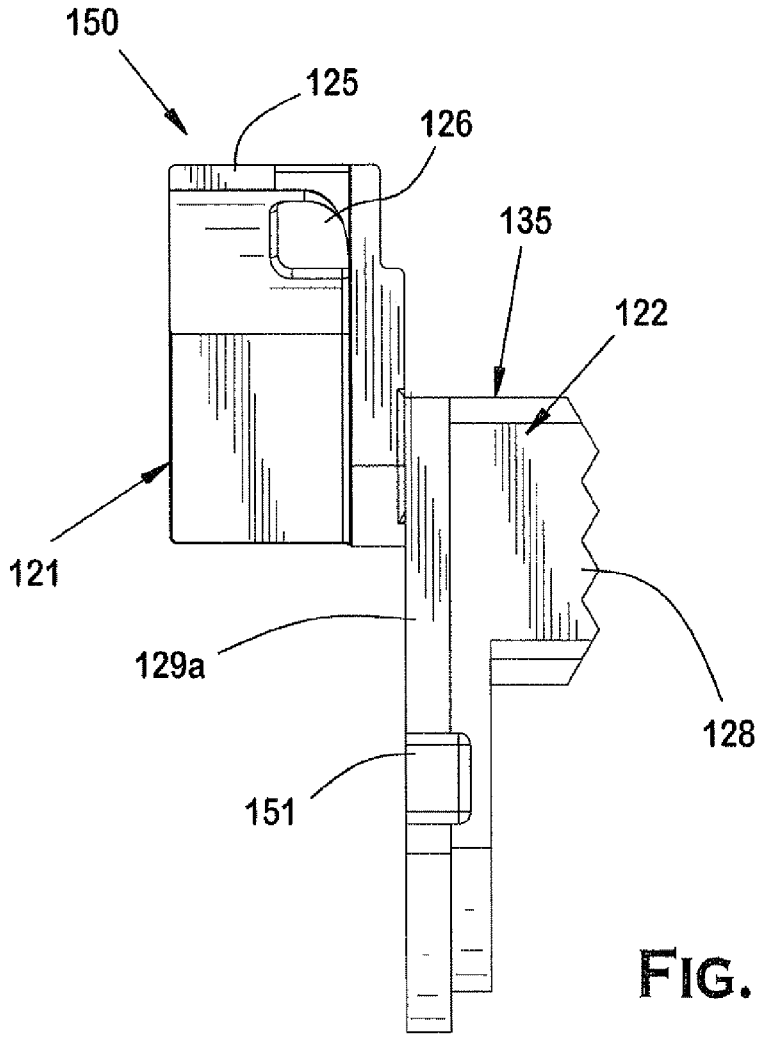
Figure 10C:
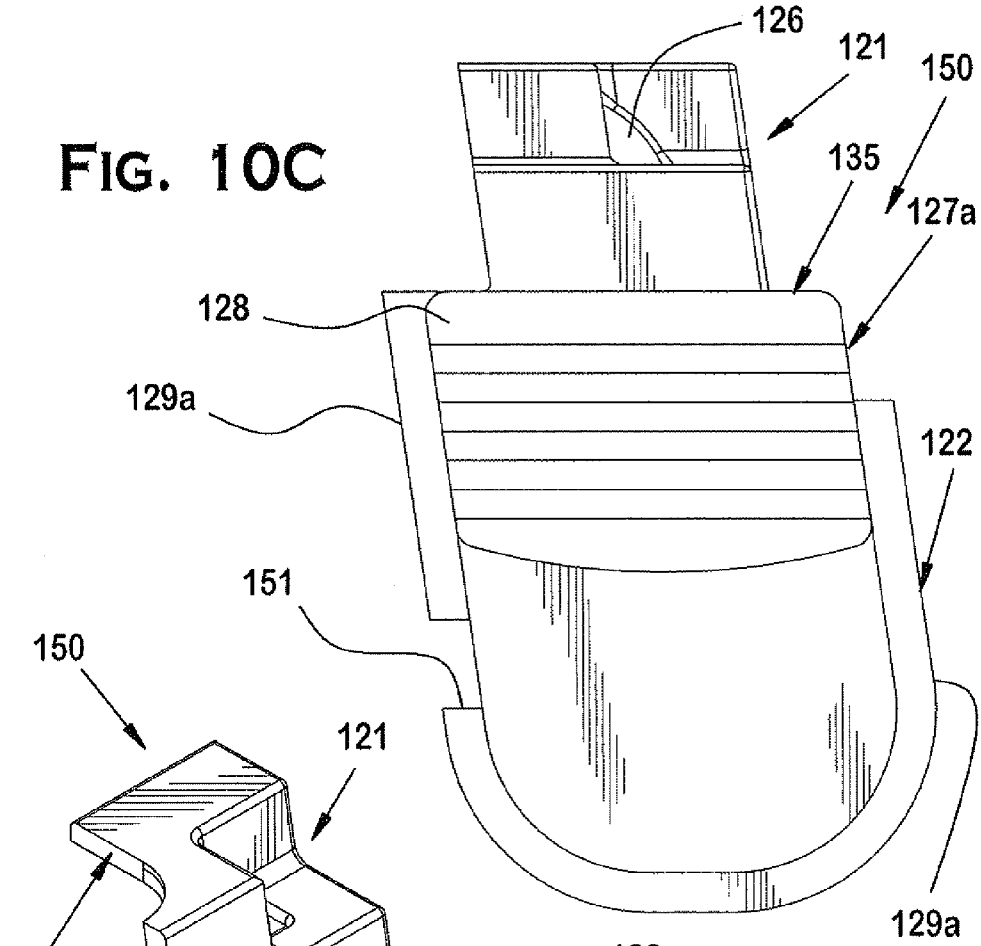
Figure 10D:
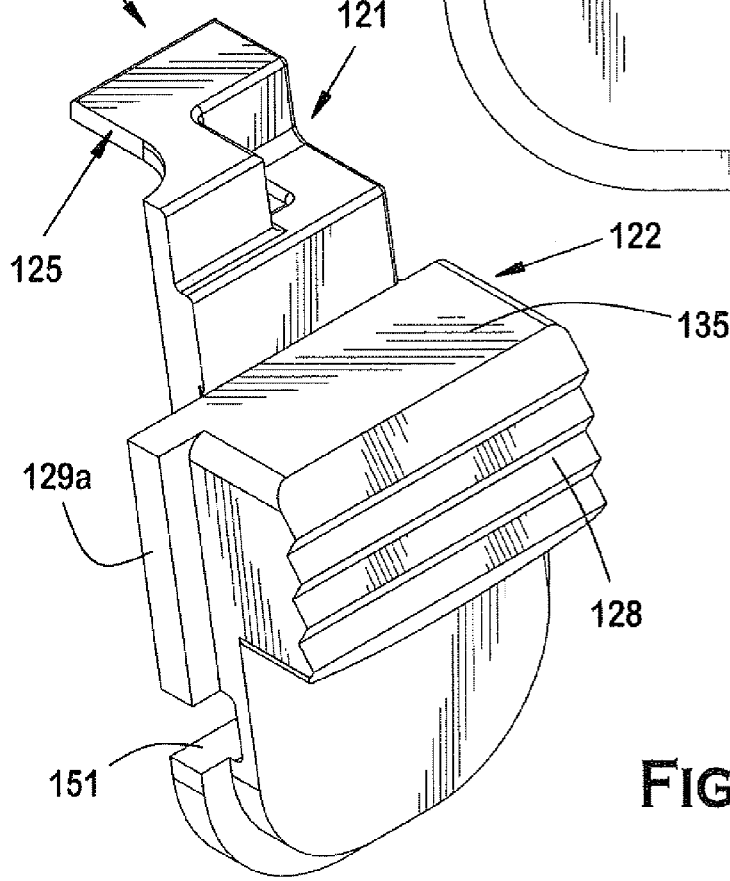
Figure 10E:
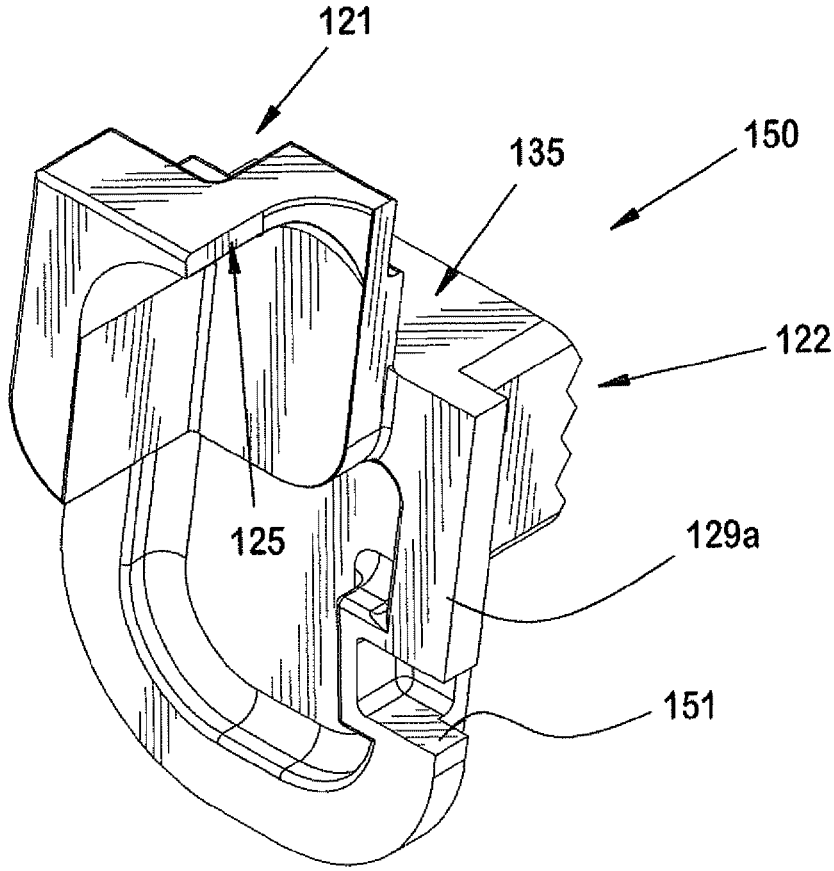

FIGS. 8, 9, and 10A-E show an alternative embodiment of a slide catch-ejector assembly 150 and slide catch-ejector spring 160 that may be used with pistol 20 in lieu of slide catch-ejector assembly 120 described herein. Whereas slide catch-ejector assembly 120 provides manually indexed movement between an upper and lower position via detent spring 130 and a pair of complementary-shaped detent notches 124 in the slide catch-ejector, slide catch-ejector assembly 150 is biased downwards towards the lower deactivated position by alternative spring 160 such that releasing the slide catch-ejector assembly 150 from the upper position automatically returns the assembly to the lower position. FIG. 8 is a left side view of pistol 20, which has the same components as the pistol shown in FIG. 2 with exception of the alternative slide catch-ejector assembly 150 and spring 160. FIG. 9 is a close-up perspective view of firing control housing 80 with alternative slide catch-ejector assembly 150 and spring 160 disposed therein. FIGS. 10A-E shows various views of the alternative slide catch-ejector assembly 150. FIG. 10A is a top view of slide catch-ejector assembly 150. FIG. 10B is a front view thereof. FIG. 10C is a side view thereof. FIGS. 10D & E are perspective views thereof.

Referring now to FIGS. 8, 9, and 10A-E, alternative slide catch-ejector assembly 150 is slidably disposed in slot 130 formed in firing control housing 80 in the same manner described herein for slide catch-ejector assembly 120 for upwards and downwards vertical movement between an upper activated position and a lower deactivated position. Alternative spring 160 includes one end 162 that engages spring notch 151 in slide catch-ejector assembly 150. Preferably, spring notch 151 is located in one side of the slide catch-ejector assembly. Spring 160 further includes a looped end 161 that is configured to engage complementary-shaped recess 82 formed in the side of firing control housing 80 (as best shown in FIG. 12) to retain the spring. Spring 160 biases slide catch-ejector assembly 150 downwards towards the lower deactivated position in which the slide catch-ejector assembly is not operative to engage cutout 127*b* in slide 24 in the manner previously described. With the exception of the addition of spring notch 151 (see FIG. 10C) and omission of spring detent notches 124 (see FIG. 7C), slide catch-ejector assembly 150 is the same in all other respects as slide catch-ejector assembly 120 described herein.

Slide catch-ejector assembly 150 operates in a similar manner to slide catch-ejector assembly 120 described above. To hold slide 24 rearward and breech area 23 in an open position, the user aligns cutout 127*b* with slide catch-ejector assembly 150 and pushes the slide catch assembly upwards from the lower deactivated position shown in FIG. 9 into the upper activated position (similar to that shown in FIG. 6B) against the downward biasing force of spring 160 to engage the cutout. Ejector 121 protrudes above the top adjacent surface of firing control housing 80 as shown in FIG. 6B. Slide 24 is then released by the user so that rear facing slide abutment surface 127*a* on slide catch 122 engages a corresponding front facing rear surface 127*c* (see FIG. 2) in the rear portion of slide cutout 127*b* as best shown in FIG. 6B (showing slide 24 in phantom lines). Slide 24 is thereby held in a rearward position against the forward biasing force of recoil spring 29 to expose the breech area 23 for inspection.

Slide 24 may then be released from slide catch-ejector assembly 150 by moving the slide slightly rearward so that the front facing rear surface 127*c* in cutout 127*b* disengages from rear facing slide abutment surface 127*a* on the slide catch-ejector assembly. Whereas slide catch-ejector assembly 120 must be manually returned downward to the lower position by the user, spring 160 automatically returns the slide catch-ejector assembly 150 downwards to the lower deactivated position shown in FIG. 9. Breach area 23 is then reclosed.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with slide catch-ejector assembly comprising:

a housing;

a slide movably mounted on a pair of opposing rails on the housing for rearward and forward axial movement; and an assembly having a slide catch portion configured for engaging the slide and an ejector portion configured for ejecting cartridge casings from the firearm, wherein the assembly is selectively slidable vertically in the housing between a deactivated position in which the slide catch portion is not engageable with the slide and an activated position in which the slide catch portion is engageable with an elongated downwardly open cutout formed in a lower side of the slide;

wherein the slide catch portion engages a front facing surface in the elongated cutout when the assembly is in the activated position for holding a breech area of the firearm open.

2. The firearm of claim 1, wherein the ejector portion defines a cartridge striking surface that is movable into and out of axial position with a chamber that receives a cartridge via moving the assembly between the deactivated and activated positions.

3. The firearm of claim 2, wherein the ejector portion is axially positioned with respect to the chamber when the assembly is in the deactivated position such that the ejector portion is positioned to contact and eject a cartridge after firing the firearm.

4. The firearm of claim 1, wherein the slide catch portion is rigidly fixed to the ejector portion to preclude relative movement between each portion.

5. The firearm of claim 1, wherein the ejector portion extends laterally inwards from the slide catch portion with respect to the housing.

6. The firearm of claim 1, wherein the assembly is biased into the deactivated position by a spring.

7. A firearm with slide catch comprising:

a housing;

a slide movably mounted on a pair of opposing rails on the housing for rearward and forward axial movement;

a barrel disposed at least partially in the slide and defining a chamber for receiving a cartridge; and a slide catch movably disposed in the housing for holding the slide in a rearward position on the frame, the slide catch including an outwardly-projecting ejector selectively slidable vertically from a first non-ejecting position to a second operating position via moving the slide catch, the ejector being axially positioned with respect to the chamber when in the operating position to eject cartridge casings from the firearm;

wherein the slide catch is selectively movable between a deactivated position in which the slide catch is not engageable with the slide and an activated position in which the slide catch portion is engageable with an elongated downwardly open cutout formed in a lower side of the slide for holding a breech area of the firearm open.

8. The firearm of claim 7, wherein the ejector is not axially positioned with respect to the chamber when in the non-ejecting position to eject cartridge casings from the firearm.

9. The firearm of claim 7, wherein the ejector defines a forward facing cartridge striking surface and the slide catch defines a rearward facing slide abutment surface configured to engage the downwardly open cutout in the slide.

10. A firearm with slide catch comprising:

a housing;

a slide movably mounted on a pair of opposing rails on the housing for rearward and forward axial movement;

a barrel disposed at least partially in the slide and defining a chamber for receiving a cartridge;

a slide catch configured for engaging the slide and vertically slidable in the housing between a deactivated position in which the slide catch is not engageable with the slide and an activated position in which the slide catch portion is engageable with an elongated downwardly open cutout formed in a lower side of the slide for holding a breech area of the firearm open; and an ejector configured for ejecting cartridge casings from the firearm and movable between an operating position in which the ejector is axially positioned with respect to the chamber to eject cartridge casings from the firearm and a non-ejecting position in which the ejector is not axially positioned with respect to the chamber to eject cartridge casings from the firearm;

the slide catch operatively cooperating with the ejector such that moving the slide catch from the deactivated position to the activated position simultaneously moves the ejector from the operating position to the non-ejecting position.

11. The firearm of claim 10, wherein the ejector is conjoined to the slide catch.

12. The firearm of claim 2, wherein the slide catch portion defines a slide abutment surface configured to engage the cutout in the slide for holding a breech area of the firearm open.

13. The firearm of claim 2, wherein the cartridge striking surface is facing in an opposite direction from the slide abutment surface.

14. The firearm of claim 13, wherein the cartridge striking surface is positioned higher on the assembly than the slide abutment surface.

15. The firearm of claim 13, wherein the cartridge striking surface is forward facing and the slide abutment surface is rear facing.

16. The firearm of claim 10, wherein the ejector portion projects upwards and laterally inwards from the slide catch portion.

17. The firearm of claim 1, wherein the assembly includes a pair of spaced-apart ears configured to slidably engage the housing of the firearm for movably retaining the assembly in the housing.

18. The firearm of claim 7, wherein the slide catch is rigidly fixed to the ejector to preclude relative movement between the slide catch and ejector.

19. The firearm of claim 7, wherein the ejector extends laterally inwards from the slide catch with respect to the housing.

* * * * *